US007632796B2

(12) United States Patent
Phenis et al.

(10) Patent No.: US 7,632,796 B2
(45) Date of Patent: Dec. 15, 2009

(54) DYNAMIC MULTI-PURPOSE COMPOSITION FOR THE REMOVAL OF PHOTORESISTS AND METHOD FOR ITS USE

(75) Inventors: Michael T. Phenis, Markleville, IN (US); Lauri Kirby Kirkpatrick, Pittsboro, IN (US); Raymond Chan, Carmel, IN (US); Diane Marie Scheele, Greenwood, IN (US); Kimberly Dona Pollard, Anderson, IN (US); Gene Goebel, Danville, CA (US)

(73) Assignee: Dynaloy, LLC, Indianapolis, IN (US)

( * ) Notice: Subject to any disclaimer, the term of this patent is extended or adjusted under 35 U.S.C. 154(b) by 613 days.

(21) Appl. No.: 11/260,912

(22) Filed: Oct. 28, 2005

(65) Prior Publication Data

US 2007/0099805 A1 May 3, 2007

(51) Int. Cl.
*C11D 7/50* (2006.01)

(52) U.S. Cl. ..... 510/175; 510/407

(58) Field of Classification Search ..... 510/175, 510/407

See application file for complete search history.

(56) References Cited

U.S. PATENT DOCUMENTS 5,648,324 A 7/1997 Honda et al.
5,795,702 A * 8/1998 Tanabe et al. ..... 430/331
5,798,323 A 8/1998 Honda et al.
6,319,835 B1 11/2001 Sahbari et al.
6,372,410 B1 4/2002 Ikemoto et al.
6,531,436 B1 3/2003 Sahbari et al.
6,579,668 B1 6/2003 Baik et al.
6,638,694 B2 10/2003 Ikemoto et al.
6,846,748 B2 1/2005 Chien et al.
6,872,663 B1 3/2005 Okada
6,878,500 B2 4/2005 Rutter, Jr. et al.
2002/0128164 A1 * 9/2002 Hara et al. ..... 510/175
2003/0181344 A1 * 9/2003 Ikemoto et al. ..... 510/175
2003/0186175 A1 * 10/2003 Ikemoto et al. ..... 430/331
2004/0048761 A1 * 3/2004 Ikemoto ..... 510/175
2004/0256358 A1 * 12/2004 Shimizu et al. ..... 216/83

OTHER PUBLICATIONS

Patent Application Search Report mailed on Jun. 5, 2008.

* cited by examiner

*Primary Examiner*—Gregory E Webb
(74) *Attorney, Agent, or Firm*—Woodard, Emhardt, Moriarty, McNett & Henry LLP

(57) ABSTRACT

Improved stripper solutions for removing photoresists from substrates are provided that typically have freezing points below about +15° C. and high loading capacities. The stripper solutions comprise dimethyl sulfoxide, a quaternary ammonium hydroxide, and an alkanolamine having at least two carbon atoms, at least one amino substituent and at least one hydroxyl substituent, the amino and hydroxyl substituents attached to two different carbon atoms. Some formulation can additionally contain a secondary solvent. Methods for use of the stripping solutions are additionally provided.

18 Claims, No Drawings

DYNAMIC MULTI-PURPOSE COMPOSITION FOR THE REMOVAL OF PHOTORESISTS AND METHOD FOR ITS USE

The present disclosure relates generally to compositions having the ability to effectively remove photoresists from substrates and methods for their use. The compositions disclosed are stripper solutions for the removal of photoresists that have the ability to remain liquid at temperatures below normal room temperature and temperatures frequently encountered in transit and warehousing and additionally have advantageous loading capacities for the photoresist materials that are removed.

SUMMARY

In broad terms, a first aspect of the present disclosure provides for a photoresist stripper solution for effectively removing or stripping a photoresist from a substrate, having particularly high loading capacities for the resist material, and the ability to remain a liquid when subjected to temperatures below normal room temperature that are typically encountered in transit, warehousing and in use in some manufacturing facilities. The compositions according to this present disclosure typically remain liquid to temperatures as low as about −20° C. to about +15° C. The compositions according to the present disclosure typically contain dimethyl sulfoxide (DMSO), a quaternary ammonium hydroxide, and an alkanolamine. One preferred embodiment contains from about 20% to about 90% dimethyl sulfoxide, from about 1% to about 7% of a quaternary ammonium hydroxide, and from about 1% to about 75% of an alkanolamine having at least two carbon atoms, at least one amino substituent and at least one hydroxyl substituent, the amino and hydroxyl substituents attached to two different carbon atoms. The preferred quaternary groups are ($C_1$-$C_8$) alkyl, arylalkyl and combinations thereof A particularly preferred quaternary ammonium hydroxide is tetramethyammonium hydroxide. Particularly preferred 1,2-alkanolamines include compounds of the formula:

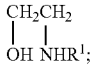

I where $R^1$ can be H, $C_1$-$C_4$ alkyl, or $C_1$-$C_4$ alkylamino. For particularly preferred alkanol amines of formula I, $R^1$ is H or $CH_2CH_2NH_2$. A further embodiment according to this present disclosure contains an additional or secondary solvent. Preferred secondary solvents include glycols, glycol ethers and the like.

A second aspect of the present disclosure provides for methods of using the novel stripper solutions described above to remove photoresist and related polymeric materials from a substrate. A photoresist can be removed from a selected substrate having a photoresist thereon by contacting the substrate with a stripping solution for a time sufficient to remove the desired amount of photoresist, by removing the substrate from the stripping solution, rinsing the stripping solution from the substrate with a solvent and drying the substrate.

A third aspect of the present disclosure includes electronic devices manufactured by the novel method disclosed.

DESCRIPTION

For the purposes of promoting an understanding of what is claimed, references will now be made to the embodiments illustrated and specific language will be used to describe the same. It will nevertheless be understood that no limitation of the scope of what is claimed is thereby intended, such alterations and further modifications and such further applications of the principles thereof as illustrated therein being contemplated as would normally occur to one skilled in the art to which the disclosure relates.

The compositions according to this present disclosure include dimethyl sulfoxide (DMSO), a quaternary ammonium hydroxide, and an alkanolamine having at least two carbon atoms, at least one amino substituent and at least one hydroxyl substituent, the amino and hydroxyl substituents attached to two different carbon atoms. Preferred quaternary substituents include ($C_1$-$C_8$) alkyl, benzyl and combinations thereof. Preferred compositions have a freezing point of less than about −20° C. up to about +15° C. and a loading capacity of from about 15 $cm^3$/liter up to about 90 $cm^3$/liter. Formulations having increased levels of an alkanolamine (Example 5, for example have the advantages are particularly noncorrosive to carbon steel are less injurious to typical waste treatments systems and auxiliary equipment than other stripper solutions. Particularly preferred compositions contain 1,2-alkanolamines having the formula:

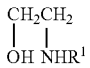

I where $R^1$ is hydrogen, ($C_1$-$C_4$) alkyl, or ($C_1$-$C_4$) alkylamino. Some preferred formulations additionally contain a secondary solvent. Particularly preferred formulations contain from about 2% to about 75% of a secondary solvent. Particularly useful secondary solvents include glycols and their alkyl or aryl ethers described in more detail below. The preferred formulations have freezing points sufficiently below 25° C. to minimize solidification during transportation and warehousing. More preferred formulations have freezing points below about 15° C. Because the preferred stripper solutions remain liquid at low temperatures, the need to liquefy solidified drums of stripper solution received during cold weather or stored in unheated warehouses before the solution can be used is eliminated or minimized. The use of drum heaters to melt solidified stripper solution is time consuming, requires extra handling and can result in incomplete melting and modification of the melted solution's composition.

Additionally, compositions according to the present disclosure display high loading capacities enabling the composition to remove higher levels of photoresists without the precipitation of solids. The loading capacity is defined as the number of $cm^3$ of photoresist or bilayer material that can be removed for each liter of stripper solution before material is redeposited on the wafer or before residue remains on the wafer. For example, if 20 liters of a stripper solution can remove 300 $cm^3$ of photoresist before either redepositon occurs or residue remains on the wafer, the loading capacity is 300 $cm^3$/20 liters =15 $cm^3$/liter The compositions typically contain about 55% to about 95% solvent, all or most of which is DMSO and from about 2% to about 10% of the quaternary ammonium hydroxide. Preferred quaternary substituents include ($C_1$-$C_8$)alkyl, benzyl and combinations thereof. When used, a secondary solvent typically comprises from about 2% to about 35% of the composition. The stripping formulations can also contain an optional surfactant, typically at levels in the range of about 0.01% to about 3%. Suitable levels of the required alkanolamine can range from about 2% to about 75% of the composition. Because some of the stripper solution's components can be provided as aqueous solutions, the composition can optionally contain small amounts of water. All %'s provided herein are weight per cents.

Suitable alkanolamines have at least two carbon atoms and have the amino and hydroxyl substituents on different carbon atoms. Suitable alkanolamines include, but are not limited to, ethanolamine, N-methylethanolamine, N-ethylethanolamine, N-propylethanolamine, N-butylethanolamine, diethanolamine, triethanolamine, N-methyldiethanolamine, N-ethyldiethanolamine, isopropanolamine, diisopropanolamine, triisopropanolamine, N-methylisopropanolamine, N-ethylisopropanolamine, N-propylisopropanolamine, 2-aminopropane-1-ol, N-methyl-2-aminopropane-1-ol, N-ethyl-2-aminopropane-1-ol, 1-aminopropane-3-ol, N-methyl-1-aminopropane-3-ol, N-ethyl-1-aminopropane-3-ol, 1-aminobutane-2-ol, N-methyl-1-aminobutane-2-ol, N-ethyl-1-aminobutane-2-ol, 2-aminobutane-1-ol, N-methyl-2-aminobutane-1-ol, N-ethyl-2-aminobutane-1-ol, 3-aminobutane-1-ol, N-methyl-3-aminobutane-1-ol, N-ethyl-3-aminobutane-1-ol, 1-aminobutane-4-ol, N-methyl-1-aminobutane-4-ol, N-ethyl-1-aminobutane-4-ol, 1-amino-2-methylpropane-2-ol, 2-amino-2-methylpropane-1-ol, 1-aminopentane-4-ol, 2-amino-4-methylpentane-1-ol, 2-aminohexane-1-ol, 3-aminoheptane-4-ol, 1-aminooctane-2-ol, 5-aminooctane-4-ol, 1-aminopropane-2,3-diol, 2-aminopropane-1,3-diol, tris(oxymethyl)aminomethane, 1,2-diaminopropane-3-ol, 1,3-diaminopropane-2-ol, and 2-(2-aminoethoxy)ethanol.

Appropriate glycol ether solvents include, but are not limited to, ethylene glycol monomethyl ether, ethylene glycol monoethyl ether, ethylene glycol monobutyl ether, ethylene mglycol dimethyl ether, ethylene glycol diethyl ether, diethylene glycol monomethyl ether, diethylene glycol monoethyl ether, diethylene glycol monopropyl ether, diethylene glycol monoisopropyl ether, diethylene glycol monobutyl ether, diethylene glycol monoisobutyl ether, diethylene glycol monobenzyl ether, diethylene glycol diethyl ether, triethylene glycol monomethyl ether, triethylene glycol dimethyl ether, polyethylene glycol monomethyl ether, diethylene glycol methyl ethyl ether, triethylene glycol, ethylene glycol monomethyl ether acetate, ethylene glycol monoethyl acetate, propylene glycol monomethyl ether, propylene glycol dimethyl ether, propylene glycol monobutyl ether, dipropyelene glycol monomethyl ether, dipropylene glycol monopropyl ether, dipropylene glycol monoisopropyl ether, dipropylene glycol monobutyl ether, dipropylene glycol dimethyl ether, dipropylene glycol dipropyl ether, dipropylene glycol diisopropyl ether, tripropylene glycol and tripropylene glycol monomethyl ether, 1-methoxy-2-butanol, 2-methoxy-1-butanol, 2-methoxy-2-methyl-2-butanol, dioxane, trioxane, 1,1-dimethoxyethane, tetrahydrofuiran, crown ethers and the like.

The compositions can also optionally contain one or more corrosion inhibitors. Suitable corrosion inhibitors include, but are not limited to, aromatic hydroxyl compounds such as catechol; alkylcatechols such as methylcatechol, ethylcatechol and t-butylcatechol, phenols and pyrogallol; aromatic triazoles such as benzotriazole; alkylbenzotriazoles; carboxylic acids such as formic acid, acetic acid, propionic acid, butyric acid, isobutyric acid, oxalic acid, malonic acid, succinic acid, glutaric acid, maleic acid, fumaric acid, benzoic acid, phtahlic acid, 1,2,3-benzenetricarboxylic acid, glycolic acid, lactic acid, malic acid, citric acid, acetic anhydride, phthalic anhydride, maleic anhydride, succinic anhydride, salicylic acid, gallic acid, and gallic acid esters such as methyl gallate and propyl gallate; organic salts of carboxyl containing organic containing compounds described above, basic substances such as ethanolamine, trimethylamine, diethylamine and pyridines, such as 2-aminopyridine, and the like, and chelate compounds such as phosphoric acid-based chelate compounds including 1,2-propanediaminetetramethylene phosphonic acid and hydroxyethane phosphonic acid, carboxylic acid-based chelate compounds such as ethylenediaminetetraacetic acid and its sodium and ammonium salts, dihydroxyethylglycine and nitrilotriacetic acid, amine-based chelate compounds such as bipyridine, tetraphenylporphyrin and phenanthroline, and oxime-based chelate compounds such as dimethylglyoxime and diphenylglyoxime. A single corrosion inhibitor may be used or a combination of corrosion inhibitors may be used. Corrosion inhibitors have proven useful at levels ranging from about 1 ppm to about 10%.

Preferred optional surfactants have included fluorosurfactants. One example of a preferred fluorosurfactant is DuPont FSO (fluorinated telomere B monoether with polyethylene glycol (50%), ethylene glycol (25%), 1,4-dioxane (<0.1%), water 25%).

Preferred temperatures of at least 50° C. are preferred for contacting the substrate whereas for a majority of applications, temperatures of from about 50° C. to about 75° C. are more preferred. For particular applications where the substrate is either sensitive or longer removal times are required, lower contacting temperatures are appropriate. For example, when reworking substrates, it may be appropriate to maintain the stripper solution at a temperature of at least 20° C. for a longer time to remove the photoresist and avoid damaging to the substrate.

When immersing a substrate, agitation of the composition additionally facilitates photoresist removal. Agitation can be effected by mechanical stirring, circulating, or by bubbling an inert gas through the composition. Upon removal of the desired amount of photoresist, the substrate is removed from contact with the stripper solution and rinsed with water or an alcohol. DI water is a preferred form of water and isopropanol is a preferred alcohol. For substrates having components subject to oxidation, rinsing is preferably done under an inert atmosphere. The preferred stripper solutions according to the present disclosure have improved loading capacities for photoresist materials compared to current commercial products and are able to process a larger number of substrates with a given volume of stripper solution.

The stripper solutions provided in this disclosure can be used to remove polymeric resist materials present in a single layer or certain types of bilayer resists. For example, bilayer resists typically have either a first inorganic layer covered by a second polymeric layer or can have two polymeric layers. Utilizing the methods taught below, a single layer of polymeric resist can be effectively removed from a standard wafer having a single polymer layer. The same methods can also be used to remove a single polymer layer from a wafer having a bilayer composed of a first inorganic layer and a second or outer polymer layer. Finally, two polymer layers can be effectively removed from a wafer having a bilayer composed of two polymeric layers.

EXAMPLES 1-13

The reactants listed in Table 1 were separately combined with stirring to give each of the 13 homogeneous stripper solutions. The freezing points were determined and are also provided in Table I. The compositions of Examples 1-13 can optionally be formulated without a surfactant and formulated to include a corrosion inhibitor.

TABLE I

| Example | Formulation* | Freezing Point, ° C. |
|---|---|---|
| 1 | 85.8 g DMSO (85.8%)<br>6.0 g Diethyleneglycol monomethyl ether (6.0%) | +13.2 |

TABLE I-continued

| Example | Formulation* | Freezing Point, ° C. |
|---|---|---|
| | 2.7 g Aminoethylethanolamine (2.7%)<br>5.5 g Tetramethylammonium hydroxide (5.5%) | |
| 2 | 61 g DMSO (61%)<br>35 g Monoethanolamine (35%) | −2.5 |
| | 4 g Tetramethylammonium hydroxide (4%) | |
| 3 | 51.5 g DMSO (51.5%)<br>35 g Diethylene glycol monomethyl ether (35%) | −7.4 |
| | 11.3 g Aminoethylethanolamine (11.3%)<br>2.2 g Tetramethylammonium hydroxide (2.2%) | |
| 4 | 71 g DMSO (71%)<br>27.4 g Monoethanolamine (27.4%) | +5.3 |
| | 1.6 g Tetramethylammonium hydroxide (1.6%) | |
| 5 | 27.4 g DMSO (27.4%)<br>71 g Monoethanolamine (71%) | +0.4 |
| | 1.6 g Tetramethylammonium hydroxide (1.6%) | |
| 6 | 86 g DMSO (86.4%)<br>6 g Diethylene glycol monomethyl ether (6%) | +7.7 |
| | 2.7 g Aminoethylethanolamine (2.7%)<br>2 g Benzyltrimethylammonium hydroxide (2%)<br>3 g water (3%) | |
| 7 | 86 g DMSO (82.1%)<br>6 g Diethylene glycol monomethyl ether (5.7%) | −4.6 |
| | 2.7 g Aminoethylethanolamine (2.6%)<br>2 g Diethyldimethylammonium hydroxide (1.9%)<br>8 g water (7.7%) | |
| 8 | 86 g DMSO (82.1%)<br>6 g Diethylene glycol monomethyl ether (5.7%) | −5.5 |
| | 2.7 Aminoethylethanolamine (2.6%)<br>2 g Methyltriethylammonium hydroxide (1.9%)<br>8 g water (7.7%) | |
| 9 | 86 g DMSO (87.5%)<br>6 g Diethylene glycol monomethyl ether (6.1%) | +8.4 |
| | 2.7 g Aminoethylethanolamine (2.8%)<br>2 g Tetrabutylammonium hydroxide (2%)<br>1.6 g water (1.6%) | |
| 10 | 63 g DMSO (61.2%)<br>35 g Monoethanolamine (34%) | −6.3 |
| | 2 g Benzyltrimethylammonium hydroxide (1.9%)<br>3 g water (2.9%) | |
| 11 | 63 g DMSO (58.3%)<br>35 g Monoethanolamine (32.4%) | <−20 |
| | 2 g Diethyldimethylammonium hydroxide (1.9%)<br>8 g water (7.4%) | |
| 12 | 63 g DMSO (58.3%)<br>35 g Monoethanolamine (32.4%) | <−20 |
| | 2 g Methyltriethylammonium hydroxide (1.9%)<br>8 g water (7.4%) | |
| 13 | 63 g DMSO (62.0%)<br>35 g Monoethanolamine (34.4%) | −6.2 |
| | 2 g Tetrabutylammonium hydroxide (2%)<br>1.6 g water (1.6%) | |

*Each formulation additionally contained and optional 0.03 g of DuPont FSO (fluorinated telomere B monoether with polyethylene glycol (50%), ethylene glycol (25%), 1,4-dioxane (<0.1%), water 25%)

EXAMPLE 14

A silicon wafer having a photoresist thereon is immersed in the stripping solution from Example 1, maintained at a temperature of about 70° C. with stirring for from about 30 to about 60 minutes. The wafer is removed, rinsed with DI water and dried. Examination of the wafer will demonstrate removal of substantially all of the photoresist. For some applications, superior results may be obtained by immersing the wafer in the stripping solution without stirring. The preferred manner of removing the photoresist from a wafer can readily be determined without undue experimentation. This method can be used to remove a single layer of polymeric photoresist or two polymeric layers present in bilayer resists having two polymer layers.

EXAMPLE 15

A silicon wafer having a photoresist thereon is mounted in a standard spray device and sprayed with the stripper solution from Example 2, maintained at about 50° C. The spraying can optionally be carried out under an inert atmosphere or optionally in the presence of an active gas such as, for example, oxygen, fluorine or silane. The wafer can be removed periodically and inspected to determine when sufficient photoresist has been removed. When sufficient photoresist has been removed, the wafer can be rinsed with isopropanol and dried. This method can be used to remove a single layer of polymeric photoresist or two polymeric layers present in bilayer resists having two polymer layers.

The methods described in Examples 14 and 15 can be used with the stripper solutions of this disclosure to remove photoresists from wafers constructed of a variety of materials, including GaAs. Additionally, both positive and negative resists can be removed by both of these methods.

EXAMPLE 16

The method described in Example 14 was used to remove photoresist from the wafers described below in Table II. Twenty liter volumes of three stripper solutions were used until either a residue of photoresist polymer remained on the wafer or until re-deposition of the polymer or its degradation products onto the wafer occurred, at which point the solutions loading capacity was reached. With this method the loading capacity was determined for the two stripper solutions described in Examples 1 and 2 above and for a comparative example that is generally typical of current commercial stripper solutions.

TABLE II

| Stripping Formulation | Composition | Wafers Stripped with 20 L of Stripper Solution | Resist Loading Capacity $cm^3/L$ |
|---|---|---|---|
| From Example 1 | 85.5 g DMSO<br>6 g Diethylene glycol monomethyl ether<br>2.7 g Aminoethylethanolamine<br>5.5 g Tetramethylammonium hydroxide<br>0.03 g DuPont FSO surfactant | 150 × 200 mm wafers with 80 μm photoresist | 18.8 |
| From Example 2 | 61 g DMSO<br>35 g Monoethanolamine<br>4 g Tetramethylammonium hydroxide<br>0.03 g DuPont FSO surfactant | 200 × 300 mm wafers with 120 μm photoresist | 84.8 |
| Comparative Example | 74 g n-methylpyrrolidone<br>24 g 1,2-propanediol<br>2 g Tetramethylammonium hydroxide | 25 × 300 mm wafers with 120 μm photoresist | 10.6 |

While applicant's disclosure has been provided with reference to specific embodiments above, it will be understood that modifications and alterations in the embodiments disclosed may be made by those practiced in the art without departing from the spirit and scope of the invention. All such modifications and alterations are intended to be covered.

What is claimed is:

1. A stripper solution for removing a photoresist from a substrate comprising from about 20 to about 90 wt. % dimethyl sulfoxide, from about 1 to about 7 wt. % of a quaternary ammonium hydroxide, from about 1 to about 75 wt. % of monoethanolamine and from about 0.01 wt. % to about 3 wt. % of a surfactant.

2. The solution of claim 1, wherein the quaternary ammonium hydroxide has substituents that are ($C_1$-$C_8$) alkyl, arylalkyl or combinations thereof.

3. The solution of claim 2, wherein the quaternary ammonium hydroxide is tetramethylammonium hydroxide.

4. The solution of claim 1, additionally comprising from about 2 to about 75 wt. % of a secondary solvent.

5. The solution of claim 1, wherein said stripper solution comprises from about 2 to about 35 wt. % of a secondary solvent.

6. The solution of claim 5, wherein the secondary solvent is a glycol ether.

7. The solution of claim 6 wherein the glycol ether is diethyleneglycol monomethyl ether.

8. The solution of claim 7, wherein the quaternary ammonium hydroxide has substituents that are ($C_1$-$C_8$) alkyl, arylalkyl or combinations thereof.

9. The solution of claim 8, wherein the quaternary ammonium hydroxide is tetramethylammonium hydroxide.

10. A stripper solution for removing a photoresist from a substrate comprising from about 20 to about 90 wt. % dimethyl sulfoxide, from about 1 to 7 wt. % of a quaternary ammonium hydroxide, from about 1 to about 75 wt. % of monoethanolamine and from about 2 to about 75 wt. % of a secondary solvent, wherein said secondary solvent is utilized with said dimethyl sulfoxide.

11. The solution of claim 10, wherein said stripper solution comprises from about 2 to about 35 wt. % of a secondary solvent.

12. The solution of claim 10, wherein the quaternary ammonium hydroxide has substituents that are ($C_1$-$C_8$) alkyl, arylalkyl or combinations thereof.

13. The solution of claim 12, wherein the quaternary ammonium hydroxide is tetramethylammonium hydroxide.

14. The solution of claim 10, wherein the secondary solvent is a glycol ether.

15. The solution of claim 14 wherein the glycol ether is diethyleneglycol monomethyl ether.

16. The solution of claim 10, additionally comprising from about 0.1 to about 3 wt. % of a surfactant.

17. The solution of claim 10, wherein the quaternary ammonium hydroxide has substituents that are ($C_1$-$C_8$) alkyl, arylalkyl or combinations thereof.

18. The solution of claim 17, wherein the quaternary ammonium hydroxide is tetramethylammonium hydroxide.

* * * * *

UNITED STATES PATENT AND TRADEMARK OFFICE

CERTIFICATE OF CORRECTION

PATENT NO. : 7,632,796 B2
APPLICATION NO. : 11/260912
DATED : December 15, 2009
INVENTOR(S) : Phenis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1013 days.

Signed and Sealed this

Twenty-first Day of December, 2010

David J. Kappos

David J. Kappos
*Director of the United States Patent and Trademark Office*